US008181611B2

(12) United States Patent
Ishida

(10) Patent No.: US 8,181,611 B2
(45) Date of Patent: May 22, 2012

(54) STRATIFIED SCAVENGING TWO-CYCLE ENGINE

(75) Inventor: Shigetoshi Ishida, Chiba (JP)

(73) Assignee: Nikko Tanaka Engineering Co., Ltd., Narashino-Shi (JP)

( * ) Notice: Subject to any disclaimer, the term of this patent is extended or adjusted under 35 U.S.C. 154(b) by 628 days.

(21) Appl. No.: 12/300,560

(22) PCT Filed: May 10, 2007

(86) PCT No.: PCT/JP2007/059628

§ 371 (c)(1),
(2), (4) Date: Apr. 1, 2009

(87) PCT Pub. No.: WO2007/132716

PCT Pub. Date: Nov. 22, 2007

(65) Prior Publication Data

US 2010/0012106 A1 Jan. 21, 2010

(30) Foreign Application Priority Data

May 16, 2006 (JP) ..... 2006-136604

(51) Int. Cl.
*F02B 25/00* (2006.01)

(52) U.S. Cl. ..... 123/73 R; 123/73 C

(58) Field of Classification Search ..... 123/73 PP, 123/73 R, 26, 73 V; 181/230; 60/314; *F02B 25/00*
See application file for complete search history.

(56) References Cited

U.S. PATENT DOCUMENTS 4,180,029 A * 12/1979 Onishi ..... 123/73 A
4,469,054 A 9/1984 Onishi et al.
6,085,703 A 7/2000 Noguchi
(Continued)

FOREIGN PATENT DOCUMENTS

EP 1 006 267 A1 6/2000
(Continued)

OTHER PUBLICATIONS

Supplementary European Search Report dated Jun. 8, 2009 issued in counterpart European Application No. 07 74 3063.

(Continued)

*Primary Examiner* — Noah Kamen
*Assistant Examiner* — Keith Coleman
(74) *Attorney, Agent, or Firm* — Holtz, Holtz, Goodman & Chick, PC

(57) ABSTRACT

Provided is a laminar-scavenging two-cycle engine, which can have a higher laminar-scavenging effect than that of the laminar-scavenging two-cycle engine of the prior art and which can expect drastically excellent effects on the stabilization of combustion and on the blow-by prevention. The laminar-scavenging two-cycle engine is characterized in that a scavenging passage (4) is constituted to include a portion (or a crankcase side portion (4*a*)) extending along a crankcase (9) and a portion (or a cylinder side portion (4*b*)) extending along a cylinder (10) and to have a length larger than the sum of the diameter and stroke of the cylinder (10), in that an ambient air introducing passage (11) for introducing the leading air into the scavenging passage (4) is connected to an intermediate portion of the scavenging passage (4), and in that a notch (8*a*) for opening a scavenging port (7) to the side of the crankcase (9) when a piston (8) is near the top dead center is formed in the piston (8).

6 Claims, 3 Drawing Sheets

U.S. PATENT DOCUMENTS

| | | | | |
|---|---|---|---|---|
| 6,240,886 | B1 | 6/2001 | Noguchi | |
| 6,257,181 | B1 | 7/2001 | Rosskamp et al. | |
| 6,450,135 | B1 | 9/2002 | Araki | |
| 6,513,466 | B2 | 2/2003 | Bignion et al. | |
| 7,469,666 | B2 * | 12/2008 | Martinsson et al. | 123/73 PP |

FOREIGN PATENT DOCUMENTS

| | | | |
|---|---|---|---|
| JP | 58-5423 | A | 1/1983 |
| JP | 05-256138 | A | 10/1993 |
| JP | 9-189229 | A | 7/1997 |
| JP | 10-121973 | A | 5/1998 |
| JP | 11-315722 | A | 11/1999 |
| JP | 2000-186560 | A | 7/2000 |
| JP | 2000-240457 | A | 9/2000 |
| JP | 2002-021571 | A | 1/2002 |

OTHER PUBLICATIONS

English Language International Search Report dated Aug. 21, 2007 issued in parent Appln. No. PCT/JP2007/059628.

* cited by examiner

STRATIFIED SCAVENGING TWO-CYCLE ENGINE

This application is a U.S. National Phase Application under 35 USC 371 of International Application PCT/JP2007/059628 filed May 10, 2007.

TECHNICAL FIELD

The present invention relates to a two-cycle engines particularly to a stratified scavenging two-cycle engine configured so that air (lead air) introduced into a scavenging channel in advance flows from a scavenging port into a cylinder during a scavenging stroke and then an air-fuel mixture passing from the crank chamber through the scavenging channel is supplied from the scavenging port into the cylinder.

BACKGROUND

An engine (stratified scavenging two-cycle engine) is conventionally known in which lead air that has been introduced in advance into a scavenging channel and a subsequent air-fuel mixture flow in a stratified manner from a scavenging port into a cylinder, whereby the non-combusted gas can be prevented from flowing out from an exhaust port (blow-bye can be prevented) during a scavenging stroke of a two-cycle engine.

A variety of systems for introducing the lead air into the scavenging channel are employed in stratified scavenging two-cycle engines. With the most basic configuration, an external air introduction path having a lead valve is connected to the scavenging channel, and the external air (lead air) flows in from the external air introduction path into the scavenging channel due to the pressure reduction in the crank chamber in the compression stroke.

Patent Document 1: Japanese Patent Application Laid-open No. 10-121973.

DISCLOSURE OF THE INVENTION

Problems to be Resolved by the Invention

The conventional two-cycle engine, as described in Japanese Patent Application Laid-open No. 11-315722, has a configuration in which an opening on the crank chamber side of the scavenging channel (starting point of the scavenging channel) is disposed in the bottom portion of the crank chamber, and the scavenging channel becomes longer than the sum of cylinder diameter and stroke. With such a configuration, combustion in each cycle can be stabilized. Furthermore, the blow-bye of fuel can be reduced and excellent effects in terms of output, thermal efficiency, exhaust gas, and vibrations can be expected.

When a technique of introducing the lead air into the scavenging channel, such as described in Japanese Patent Application laid-open No. 10-121973, is applied to a two-cycle engine configured to have a long scavenging channel, the scavenging stratification effect can be further improved and excellent effects in terms of combustion stabilization and blow-bye prevention can be expected.

However, in the engine described in Japanese Patent Application Laid-open No. 10-121973, the lead air is introduced from a site that is close to the scavenging port (end of the scavenging channel) located in a position farthest from the opening on the crank chamber side of the scavenging channel (starting point of the scavenging channel). Therefore, when the engine is configured to have a long scavenging channel, a corresponding time is required to fill the entire region (from the end to the starting point) of the scavenging channel and it is possible that within a very small interval of each cycle the lead air will not reach the opening on the crank chamber side of the scavenging channel and the lead air will not be sufficiently introduced.

In the case in which an external air introduction path is connected to an intermediate site of the scavenging channel and the lead air flows from the connected portion thereof into the scavenging channel, instead of introducing the lead air from a site close to the scavenging port, it will apparently be possible to cause the lead air to reach the opening on the crank chamber side of the scavenging channel in a manner easier than that in the case where the lead air is caused to flow in from the scavenging port, but in this case the problem is that the air-fuel mixture remaining in a region from the connected portion of the external air introduction path to the scavenging port within the internal space of the scavenging channel will not be purged and it will be difficult to fill this region with pure lead air.

The present invention has been created to resolve this problem inherent to the conventional technology, and it is an object of the present invention to provide a stratified scavenging two-cycle engine in which the scavenging stratification effect can be improved by comparison with that of the conventional stratified scavenging two-cycle engine and excellent effects in terms of combustion stabilization and blow-bye prevention can be expected.

Means of Solving the Problems

The stratified scavenging two-cycle engine in accordance with the present invention is characterized in that: a scavenging channel has a portion (portion on a crank chamber side) extending along a crank chamber and a portion (portion on a cylinder side) extending along a cylinder, and the scavenging channel is configured to have a length larger than a sum of cylinder diameter and stroke; an external air introduction path for introducing a lead air into the scavenging channel is connected to an intermediate site of the scavenging channel; and a cutout or a hole that opens a scavenging port on the crank chamber side when a piston is close to a top dead center is formed in the piston. The external air introduction path is preferably connected to a position, within the portion on the cylinder side of the scavenging channel, that is closest to an opening on the crank chamber side.

Further, a configuration is also preferred in which the opening on the crank chamber side of the scavenging channel is opened in a position closest to the trajectory of an outer peripheral surface of a crank weight, and the crank weight serves as a resistance when the lead air flows into a portion on the crank chamber side of the scavenging channel.

Advantageous Effects of the Invention

With the stratified scavenging two-cycle engine in accordance with the present invention, although the scavenging channel is formed longer than that of the typical configuration, the entire region of the scavenging channel can be filled with the lead air. Therefore, a sufficient amount of the lead air can be supplied into the cylinder, the scavenging stratification effect can be further improved, and excellent effect in terms of combustion stabilization and blow-bye prevention can be expected.

BEST MODE FOR CARRYING OUT THE INVENTION

The best mode for carrying out the present invention will be described below with reference to the appended drawings.

FIG. 1 is a cross-sectional view of a stratified scavenging two-cycle engine 1 of the first embodiment of the present invention. In the figure, the reference numeral 2 stands for an intake channel, 3—an exhaust channel, 4—a scavenging channel, 5—a suction port, 6—an exhaust port, 7—a scavenging port. Further, the reference numeral 8 stands for a piston, 9—a crank chamber, 10—a cylinder, 17—a carburetor, 18—an insulator, 19—a throttle valve, and 20—an air valve.

In a typical two-cycle engine, a starting point of the scavenging channel (an opening on the crank chamber side) is open in the upper portion of the crank chamber, but in the present embodiment, the starting point (opening 13 on the crank chamber side) of the scavenging channel is open in a bottom portion 9*a* of the crank chamber 9. The scavenging channel 4 of the present embodiment is mainly composed of a portion (portion 4*a* on the crank chamber side) extending along the crank chamber 9 from the opening 13 on the crank chamber side to the position above the crank chamber 9, a portion (portion 4*b* on the cylinder side) extending along the cylinder 10 from the position above the crank chamber 9 to the scavenging port 7, and a portion (linking portion 4*c*) linking the portion 4*a* on the crank chamber side and the portion 4*b* on the cylinder side, and this scavenging channel is longer (longer that the sum of cylinder diameter and stroke) than the scavenging channel of a typical two-cycle engine (only a portion extending from a position above the crank chamber to the scavenging port).

Further, in the present embodiment, an external air introduction path 11 is connected to an intermediate site (position closer to the opening 13 on the crank chamber side than the scavenging port 7) of the scavenging channel 4. A lead valve 12 is mounted on the external air introduction path 11, and the external air purified by an air cleaner (not shown in the figure) pushes and opens the lead valve 12, flows down the external air introduction path 11, and flows into the scavenging channel 4.

The operation of the stratified scavenging two-cycle engine 1 of the first embodiment will be described below As shown in FIG. 1, when the piston 8 rises from the bottom dead center to the top dead center, the pressure inside the crank chamber 9 becomes negative, and the air-fuel mixture (new air) flows from a carburetor (not shown in the figure) via the intake channel 2 into the crank chamber 9 due to the difference in pressure.

In this case, because the scavenging channel 4 communicates with the crank chamber 9 via the opening 13 on the crank chamber side, the pressure in the space inside the scavenging channel 4 also becomes negative, as in the crank chamber 9, and the external air (lead air) purified by the air cleaner (not shown in the figure) pushes and opens the lead valve 12, flows down the external air introduction path 11, and flows into the scavenging channel 4, due to this difference in pressure.

Because the external air introduction path 11 is connected to an intermediate site (position closer to the opening 13 on the crank chamber side than the scavenging port 7) of the scavenging channel 4, as described hereinabove, the lead air can be caused to reach the opening 13 on the crank chamber side of the scavenging channel 4 in a manner easier than that in the case in which the lead air is introduced from a site close to the scavenging port 7.

In the state shown in FIG. 1, because the scavenging port 7 is closed by the piston 8, although the lead air is caused to flow into the scavenging channel 4, the air-fuel mixture remaining in a region (portion 4*b* on the cylinder side) from a connected portion 11*a* of the external air introduction path 11 to the scavenging port 7 cannot be purged and this region cannot be filled with pure lead air. However, in the present invention, because a cutout 8*a* that opens the scavenging port 7 on the side of the crank chamber 9 when the piston 8 is close to the top dead center is formed at the lower edge of the piston 8, as shown in FIG. 2 the air-fuel mixture remaining in the portion 4*b* on the cylinder side of the scavenging channel 4 is pushed out by the lead air and caused to flow to the side of the crank chamber 9 within the interval from the moment the cutout 8*a* starts to open the scavenging port 7 to the complete opening of the port, and the inside of the portion 4*b* on the cylinder side is tilled with the lead air.

Thus, in the stratified scavenging two-cycle engine 1 of the present embodiment, although the scavenging channel 4 is formed longer than that of the typical configuration, the entire region of the scavenging channel 4 (from the opening 13 on the crank chamber side to the scavenging port 7) can be filled with the lead air. Therefore, in the exhaust-scavenging stroke in which the piston 8 moves down toward the bottom dead center, a sufficient amount of lead air can be supplied into the cylinder 10, the scavenging stratification effect can be further improved, and excellent effect in terms of combustion stabilization and blow-bye prevention can be expected.

In the present embodiment, the configuration is such that, as shown in FIG. 3 (cross-sectional view of the crank case 14 along the X-X line shown in FIG. 2), the opening 13 on the crank chamber side of the scavenging channel 4 that is formed in the bottom portion 9*a* of the crank chamber 9 is opened in a position that is closest to the trajectory of an outer peripheral surface 15*a* of a crank weight 15 rotating about a crank shaft 16, and when the crank weight 15 is located within a range of approximately 90° about the state shown in FIG. 2 as a center (when the piston 8 is positioned above the intermediate point of the stroke), the outer peripheral surface 15*a* crosses the space close to the opening 13 on the crank chamber side. Therefore, the crank weight 15 serves as a resistance when the lead air flows into the portion 4*a* on the crank chamber side of the scavenging channel 4, and the introduction of the lead air into the portion 4*b* on the cylinder side of the scavenging channel 4 can be performed smoothly within the interval from the moment the cutout 8*a* of the piston 8 starts to open the scavenging port 7 to the complete opening of the port.

Explaining this matter in greater details the effective configuration is such that when the pressure inside the crank shaft 9 becomes negative as the piston 8 rises from the bottom dead center to the top dead center, the lead air flows into the scavenging channel 4, but because in the scavenging channel 4 the lead air first starts to flow into the portion 4*a* on the crank chamber side and the linking portion 4*c* and finally the lead air flows into the portion 4*b* on the cylinder side (within the interval from the moment the cutout 8*a* of the piston 8 starts to open the scavenging port 7 on the side of the crank chamber 9 to the complete opening of the port, as the piston 8 approaches the top dead center), after the scavenging port 7 started to open on the side of the crank shaft 9, the amount of the lead air flowing into the portion 4*b* on the cylinder side becomes larger than the amount of lead air flowing into the portion 4*a* on the crank chamber side and the linking portion 4*c*.

In the present embodiment the configuration is such that the outer peripheral surface 15*a* of the crank weight 15 crosses the space close to the opening 13 on the crank chamber side at least "within the interval from the moment the cutout 8*a* of the piston 8 starts to open the scavenging port 7 on the side of the crank chamber 9 to the complete opening of the port". Therefore, the crank weight 15 serves as a resistance when the lead air flows into the portion 4*a* on the crank chamber side of the scavenging channel 4. As a result, the amount of the lead air introduced into the portion 4*b* on the cylinder side increases and the introduction of the lead air into the portion 4*b* on the cylinder side can be performed smoothly.

Figure 1:
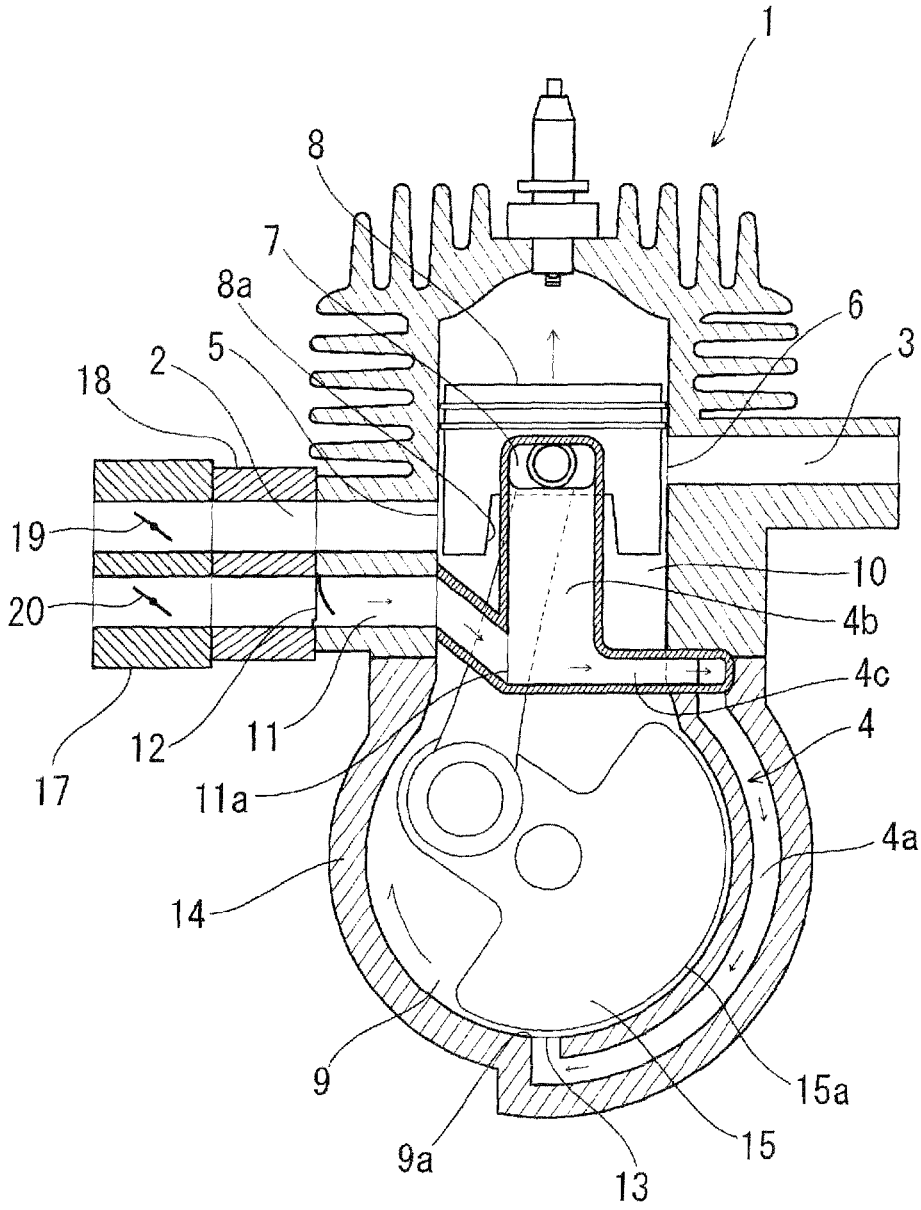
FIG. 1 is a cross-sectional view of the stratified scavenging two-cycle engine 1 of the first embodiment of the present invention.
Figure 2:
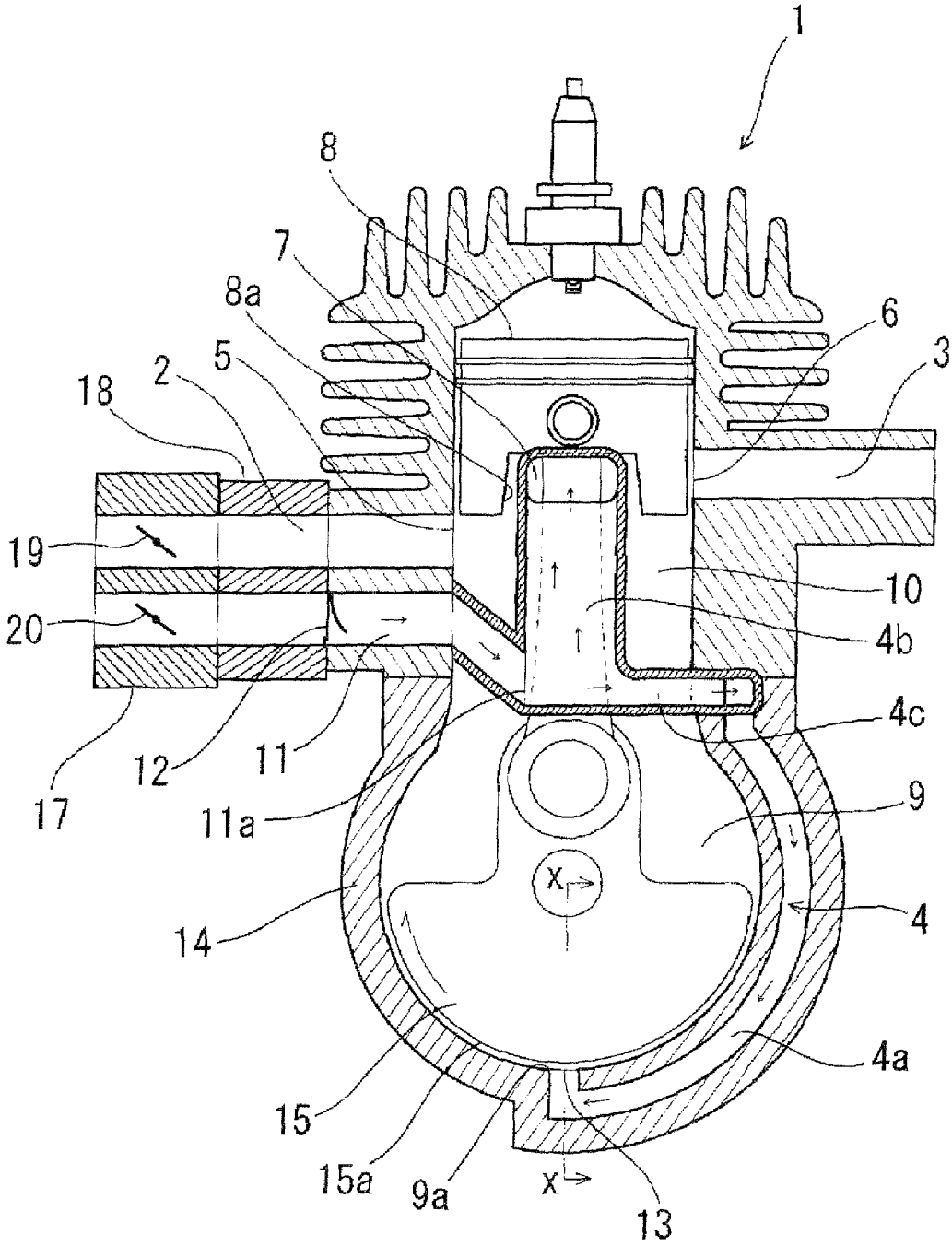
FIG. 2 is a cross-sectional view (state in which the piston 8 is in the top dead center) of the stratified scavenging two-cycle engine 1 of the first embodiment of the present invention.
Figure 3:
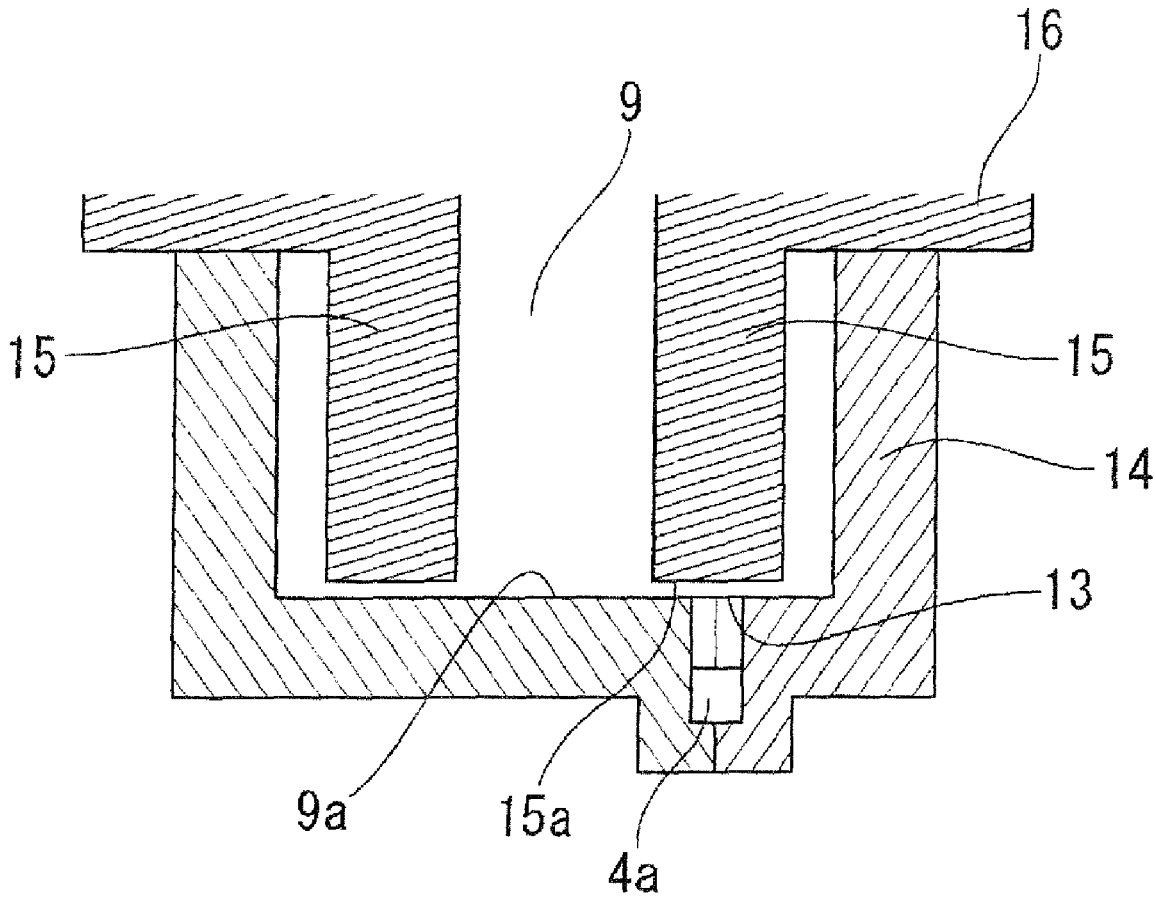
FIG. 3 is a cross-sectional view of the crank case 14 along the X-X line shown in FIG. 2.

1: engine
2: intake channel
3: exhaust channel
4: scavenging channel
4*a*: portion on the crank chamber side
4*b*: portion on the cylinder side
4*c*: linking portion
5: suction port
6: exhaust port
7: scavenging port
8: piston
9: crank chamber
9*a*: bottom portion
10: cylinder
11: external air introduction path
11*a*: connected portion
12: lead valve
13: opening on the crank chamber side
14: crank case
15: crank weight
15*a*: outer peripheral surface
16: crank shaft
17: carburetor
18: insulator
19: throttle valve
20: air valve

The invention claimed is:

1. A stratified scavenging two-cycle engine comprising:
a cylinder;
a piston;
a crank chamber;
a scavenging channel including a crank-chamber side portion that extends along the crank chamber and a cylinder-side portion that extends along the cylinder;
an external air introduction path for introducing lead air into the scavenging channel, the external air introduction path being connected to an intermediate position of the scavenging channel; and
an opening portion formed in the piston;
wherein:
the opening portion and a scavenging port are relatively positioned such that when the piston is located close to top dead center, the scavenging port is opened via the opening portion so that the crank chamber communicates with the scavenging channel via the opening portion and the scavenging port; and
the engine comprises communication-preventing means for preventing communication between the crank chamber and the crank-chamber-side portion of the scavenging channel through a starting point of the scavenging channel that is open to the crank chamber, when the piston is located close to top dead center, such that an air-fuel mixture remaining in the cylinder-side-portion of the scavenging channel is pushed out by the lead air introduced via the external air introduction path and caused to flow into the crank chamber via the scavenging port when the piston is located close to top dead center.

2. The stratified scavenging two-cycle engine according to claim 1, wherein the external air introduction path is connected to a position of the cylinder-side portion of the scavenging channel that is closest to the starting point of the scavenging channel that is open to the crank chamber.

3. The stratified scavenging two-cycle engine according to claim 1, wherein a length of the scavenging channel is larger than a sum of a diameter and stroke of the cylinder.

4. The stratified scavenging two-cycle engine according to claim 1, wherein the opening portion comprises a cutout.

5. The stratified scavenging two-cycle engine according to claim 1, wherein the opening portion comprises a hole.

6. The stratified scavenging two-cycle engine according to claim 1, the communication-preventing means comprises a crank weight that rotates in the crank chamber to close the starting point of the scavenging channel that is open to the crank chamber.

* * * * *